United States Patent [19]

Yoshimura et al.

[11] 4,221,303

[45] Sep. 9, 1980

[54] ANTICORROSIVE LIQUID TANK WITH OFFSET LINING JOINTS

[75] Inventors: Yukio Yoshimura, Shiga; Masahisa Sonku, Hikone, both of Japan

[73] Assignee: Sekisui Kagaku Kogyo Kabushiki Kaisha, Osaka, Japan

[21] Appl. No.: 883,426

[22] Filed: Mar. 3, 1978

[30] Foreign Application Priority Data

Mar. 3, 1977 [JP] Japan ..... 52/23407

[51] Int. Cl.[2] ..... B65D 25/14

[52] U.S. Cl. ..... 220/461; 52/265; 52/309.13; 206/524.2; 206/524.3

[58] Field of Search ..... 220/453, 460, 461, 464, 220/435, 436; 52/309.1, 169.7, 169.14, 265, 309.13; 428/461, 462, 35, 60, 58, 59; 206/524.2, 524.3

[56] References Cited

U.S. PATENT DOCUMENTS

| | | | |
|---|---|---|---|
| 1,367,231 | 2/1921 | Boyer | 206/524.3 X |
| 1,919,366 | 7/1933 | Haines | 220/460 X |
| 2,311,004 | 2/1943 | Thomas et al. | 206/524.3 X |
| 2,321,777 | 6/1943 | Schelhammer et al. | 220/461 X |
| 2,821,294 | 1/1958 | Montgomery | 220/460 X |
| 2,956,915 | 10/1960 | Korn et al. | 220/453 X |
| 3,272,318 | 9/1966 | Saxman | 206/524.2 |
| 3,286,822 | 11/1966 | Saxman | 206/524.2 |
| 3,505,769 | 4/1970 | Miron et al. | 52/309.13 X |
| 3,519,164 | 7/1970 | Lehto | 220/453 |
| 3,686,061 | 8/1972 | Brown et al. | 428/60 |
| 3,738,527 | 6/1973 | Townsend | 220/461 X |
| 3,896,963 | 7/1975 | Schisler | 220/461 |
| 3,904,068 | 9/1975 | Beaujean | 220/461 X |

FOREIGN PATENT DOCUMENTS

| | | | |
|---|---|---|---|
| 922746 | 4/1963 | United Kingdom | 428/60 |

*Primary Examiner*—Allan N. Shoap

*Attorney, Agent, or Firm*—Sughrue, Rothwell, Mion, Zinn and Macpeak

[57] ABSTRACT

A steel or concrete liquid tank body 1 has an adhesively secured internal cushioning layer of rubber sheets 2 underlying an adhesively secured lining of corrosion resistant synthetic resin sheets 4. The angular tank body corners are provided with triangular rubber strips 3 to contour the lining sheets and avoid stress concentrations. The overlapping glued and welded joints a between adjacent resin sheets 4 are staggered or offset with respect to the mitered joints b between adjacent rubber sheets, and the corners of the interior of the joints a are spaced from the tank.

5 Claims, 2 Drawing Figures

ANTICORROSIVE LIQUID TANK WITH OFFSET LINING JOINTS

BACKGROUND OF THE INVENTION

This invention relates to a liquid tank having a cushioned, anticorrosive internal lining. Such a tank may be used for electroanalysis, electrolysis, electroplating, waste water processing, exhaust gas processing, and the like. Liquid tanks made of concrete, steel, etc. for containing corrosive chemical solutions are conventionally directly lined with corrosion resistant materials such as synthetic resin sheets secured to the tank body by adhesion, bolting, etc., but such tanks are not always sufficiently durable since the lined sheets tend to peel off or crack due to differences in the thermal expansion coefficients of the tank body and the sheets and the physical impact of items dropped into the tank.

It has therefore been proposed to interpose shock absorptive sheets between the tank body and the anticorrosive lining sheets, and this is reasonably effective to cope with thermal tensions and physical impacts. There are typically variations in durability between the shock absorptive sheets and the lining sheets, however, depending on the method used to separately or commonly secure them to the tank. This is due to the fact that a relatively large liquid tank must be lined with a plurality of sheets of both materials, and the liquid in the tank often leaks through the joints between adjacent sheets.

SUMMARY OF THE INVENTION

According to this invention the above drawbacks and disadvantages of the prior art are effectively overcome by providing a liquid tank having sheets of shock absorptive material adhesively secured over its internal surface to form a cushioning layer, and sheets of corrosion resistant synthetic resin adhesively secured as a lining layer over the shock absorptive sheets. The arrangement is such that the joints between adjoining resin sheets are staggered with respect to the joints of the shock absorptive sheets, and are spaced from the liquid-containing interior of the angular corners of the tank.

DETAILED DESCRIPTION OF THE PREFERRED EMBODIMENTS

Figure 2:
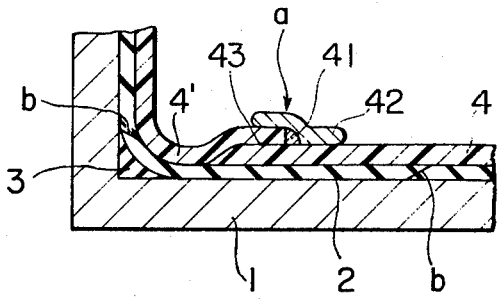
FIG. 2 shows a partially enlarged cross-section of a tank corner FIG. 1.

Referring now to the drawings, reference numeral 1 designates a liquid tank body of metal, concrete, etc., which may be provided with a layer of heat insulating material (not shown) around its external surface if required. After the internal surface of the tank body 1 is thoroughly cleaned, as by sandblasting off any rust, welding scale, etc. if it is made of iron plate, sheets 2 of butyl rubber or the like are adhesively secured in place to form a cushioning or shock absorbing layer. At the angular corners of the tank body 1 substantially triangular rubber members 3 are installed in advance to insure the smooth and placid adhesion of the rubber sheets 2. The edges of the rubber sheets are also cut at an angle of about 30° to accurately fit with the edges of the similarly cut adjoining sheets, as seen in FIG. 2, and the joints between adjoining sheets are secured together with adhesive. In this manner the joints between the rubber sheets are no thicker than the central areas thereof.

Corrosion resistant synthetic resin sheets 4 are next applied over the rubber sheets 2, but prior to this it is desirable to inspect the rubber sheets for any imperfections and make any necessary repairs. Such imperfections can be detected by the swelling produced as trapped air bubbles expand and inflate when the rubber sheets are heated by blowing hot air over them or by generally heating the air inside the tank.

A semirigid vinyl chloride resin containing 10 to 50% of plasticizer is preferred for the corrosion resistant synthetic resin sheets 4, especially one containing about 30% of plasticizer. Semirigid vinyl chloride resin sheets are most suitable for the corrosion resistant lining because they are reasonably soft and easy to handle, have good adhesive characteristics, leave a smooth and undistorted surface after welding or adhesion, resist hardening even at low temperatures, and have high impact resistance.

Figure 1:
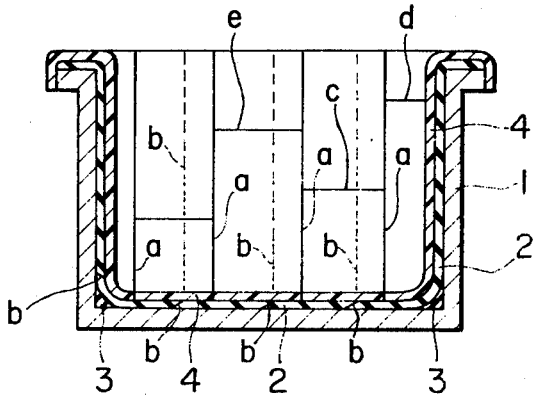
FIG. 1 shows a cross-sectional elevation of an anticorrosive liquid tank constructed in accordance with the present invention.

The resin sheets 4 are secured to the rubber sheets 2 with rubber adhesive or the like. The joints between the sheets are made secure and rigid by using a combined wrappng and welding connection, an example of which is shown in FIG. 2. The edge portion of a rubber sheet 4 is first cut diagonally, inserted under the edge of another sheet 4', and the interfacing surfaces are glued together. The joint is then further welded by using a welding rod 41 and an overlying welding belt 42. It is also desirable to interpose an electrical conductor 43 such as copper wire in the overlapped portion about 10 mm from its edge to permit the easy detection of pinholes after the completion of the connection. The joints a of the resin sheets must be staggered with respect to the joints b of the rubber sheets to avoid overlapping, and it is desirable to separate the joints a and b by more than 150 mm. It is also necessary to space the joints a from the interior of the angular corners of the tank. These measures are done to protect the joints of the resin sheets 4 and maintain good tightness to hold liquids for a long period of time by avoiding the joints of the rubber sheets and the angular tank corners where various tensions tend to be concentrated. It is also desirable to stagger the horizontal connecting line c between the short sides of two resin sheets with respect to the horizontal connecting lines d and e between the short sides of adjacent sheets to avoid any joint line alignment, as shown in FIG. 1.

What is claimed is:

1. In an anticorrosive tank for caustic liquids or the like including a tank body, a cushioning layer comprising adjoining sheets of shock absorptive material adhesively secured to the internal surface of the tank body, and a lining layer comprising adjoining sheets of corrosion resistant synthetic resin material overlying and adhesively secured to the shock absorptive sheets, said corrosion resistant synthetic material forming a liquid-containing interior tank surface the improvements characterized by:

(a) the joints between adjacent resin sheets being offset from the joints between adjacent shock absorptive sheets, and (b) the resin sheet joints being spaced from the corners of the liquid-contacting interior surface of the tank, and (c) the adjoining resin sheets are generally rectangular and have long and short sides, and the horizontal joint lines between the short sides of adjoining resin sheets are staggered with respect to the horizontal joint lines between the short sides of resin sheets adjacent each other along the long sides.

2. An anticorrosive tank as defined in claim 1, wherein the tank body is generally rectangular, and further comprising generally triangular contour strips of elastic material fitted in the corners of the tank body.

3. An anticorrosive tank as defined in claims 1 or 2, wherein the shock absorptive sheets are made of rubber.

4. An anticorrosive tank as defined in claims 1 or 2, wherein the corrosion resistant synthetic resin sheets are made of semirigid vinyl chloride resin containing 10% to 50% of a plasticizer.

5. An anticorrosive tank as defined in claims 1 or 2, wherein the shock absorptive sheet joints are mitered, and the resin sheet joints are adhesively overlapped and welded.

* * * * *